US006154991A

United States Patent [19]

Duncan et al.

[11] Patent Number: 6,154,991

[45] Date of Patent: Dec. 5, 2000

[54] FABRIC WORKPIECE HOLDER

[76] Inventors: Janet F. Duncan; Roger M. Duncan, both of 15627 Broadway, Snohomish, Wash. 98296

[21] Appl. No.: 09/428,864

[22] Filed: Oct. 26, 1999

Related U.S. Application Data

[60] Provisional application No. 60/149,646, Aug. 18, 1999.

[51] Int. Cl.[7] ..... D06C 3/08

[52] U.S. Cl. ..... 38/102.2

[58] Field of Search ..... 38/102, 102.1, 38/102.2, 102.91; 160/371, 378, 380; 24/712.9, 128, 130

[56] References Cited

U.S. PATENT DOCUMENTS

| | | | |
|---|---|---|---|
| 352,769 | 11/1886 | Moon et al. | 38/102.2 |
| 570,940 | 11/1896 | Maynard . | |
| 707,353 | 8/1902 | Post . | |
| 901,246 | 10/1908 | Lyon . | |
| 929,583 | 7/1909 | Gibbs . | |
| 998,657 | 7/1911 | Thomas . | |
| 1,016,463 | 2/1912 | Wilkins . | |
| 1,056,966 | 3/1913 | Belding . | |
| 1,078,809 | 11/1913 | Thomas . | |
| 1,221,123 | 4/1917 | Westhaver . | |
| 1,242,972 | 10/1917 | Pettit . | |
| 1,357,737 | 11/1920 | Solaini . | |
| 3,906,647 | 9/1975 | Bates, Jr. | 38/102.2 |
| 4,422,250 | 12/1983 | Golan | 38/102.2 |
| 5,303,486 | 4/1994 | Dell | 38/102.2 |
| 5,555,653 | 9/1996 | Morgan | 38/102.2 |

FOREIGN PATENT DOCUMENTS

| | | | |
|---|---|---|---|
| 659410 | 8/1922 | France | 38/102.2 |
| 651306 | 2/1928 | France | 38/102.2 |

*Primary Examiner*—Ismael Izaguirre
*Attorney, Agent, or Firm*—Garrison & Associates PS; David L. Garrison

[57] ABSTRACT

A fabric workpiece holder is described for holding workpieces for various craft activities such as quilting and embroidery. The workpiece holder consists of a rigid hoop having a circumferential groove on its outer surface, an elastic cord that wraps around the fabric workpiece after it has been draped over the rigid hoop, and engages the circumferential groove on the hoop, and a novel clamp that allows the user to securely tighten the elastic cord, and maintain the tension therein, holding the fabric workpiece to the hoop. A unique feature of the clasp is an indexing ridge on the back surface that engages the groove on the hoop through the fabric. The ends of the elastic cord slide into holes on either side of the clasp and when the cord is tightened the clasp, including the ridge, are pulled toward the hoop. One end of the elastic cord is knotted or otherwise enlarged retaining it in the clasp, and a locking groove is provided on the face of the clasp allowing the user to maintain tension in the elastic cord.

11 Claims, 2 Drawing Sheets

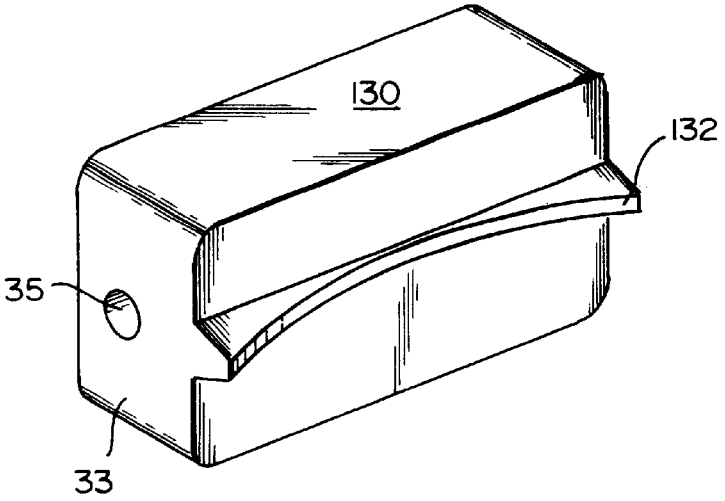
FIG. 5
FIG. 5A
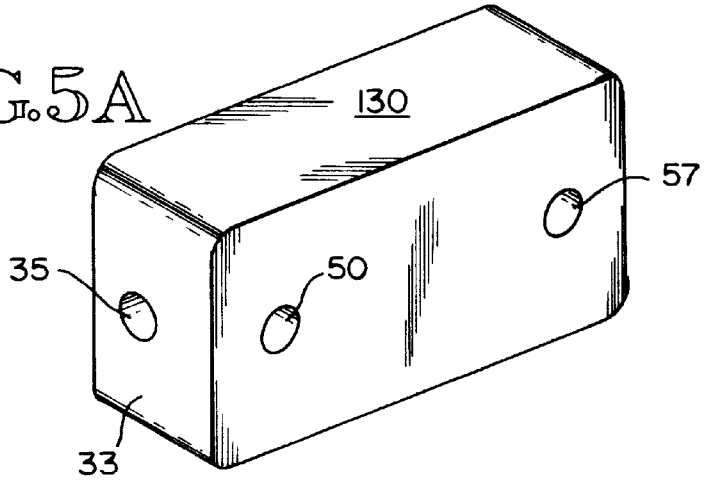
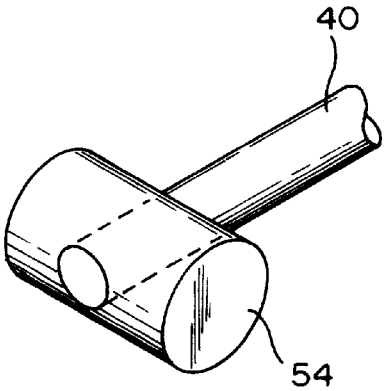
FIG. 6

FABRIC WORKPIECE HOLDER

This application claims the benefit of U.S. Provisional application Ser. No. 60/149,646, entitled Fabric Workpiece Holder, and filed Aug. 18, 1999. This invention relates to a fabric workpiece holder for embroidery, quilting and other crafts, and more particularly to a single-hoop apparatus employing an adjustable elastic cord that holds the fabric to the hoop.

FIELD OF THE INVENTION

Background of the Invention

Quilting and embroidery hoops of the prior art typically consist of two concentric rings or hoops: an outer hoop having an inner diameter D and an inner hoop having an outer diameter close to D such that the inner ring fits snugly inside the outer ring. The fabric workpiece must be held in tension to facilitate the needlework or other craft to be performed thereon. In traditional workpiece holders, the fabric workpiece is draped over the inner ring, and the outer ring is then slid over the top of the inner ring producing a friction fit between the inner and outer ring with a portion of the workpiece fabric therebetween, thereby securing the fabric workpiece with a portion of the fabric in tension. A common problem with such devices is maintaining sufficient tension in the workpiece during the time the user is working on the fabric. Various devices and schemes have been proposed to overcome this problem. One example of such a device may be seen in U.S. Pat. No. 4,723,367 to Samoilov et al. This patent discloses an embroidery hoop in which the inner surface of the outer hoop has a groove and the outer surface of the inner hoop has a protrusion adapted to be received in the groove thereby more securely holding the material trapped between the inner and outer loops, and reducing the tendency of the fabric to slip during the time a person is working on it.

Another problem encountered in traditional workpiece holders is the inability of the apparatus to accommodate varying thickness of fabric. When concentric inner and outer rings are utilized to tension a piece of fabric, both rings must be precisely sized and the two rings can therefore only accommodate fabric having a very narrow range of thickness. If the desired fabric workpiece thickness changes significantly, one or both of the rings must be replaced. An example of a prior art device designed to accommodate fabric of different thicknesses is U.S. Pat. No. 570,940 to Maynard. Maynard discloses an embroidery holder having a ring with an outer groove and a wire band which may be coiled to provide elasticity. A cord is interlaced between the coils of the spring to take up any stretch in the spring. An alternative approach to this problem may be seen in U.S. Pat. No. 998,657 to Thomas. Thomas discloses an embroidery hoop having a pair of concentric rings. The inner ring is rigid and the outer ring is elastic. The elastic ring has an inner wire the ends of which are connected by springs. Another device having a fixed inner ring and a resilient outer ring is disclosed in U.S. Pat. No. 1,221,123 to Westhaver. In Westhaver the resilient ring consists of a plurality of rubber bands having their ends joined together. Although fabric holders having one fixed ring and a fixed length resilient outer ring can accommodate fabrics having varying thicknesses, they lack the ability to increase or decrease the force applied to trap the fabric between the two brings.

Another approach to accommodating different fabric thicknesses is found in U.S. Pat. No. 1,242,972 to Pettit. Pettit discloses a single piece of rigid wire that is adapted to fit within a groove formed in a loop to trap fabric between the groove and the wire. The ends of the wire may be twisted toward each other to tighten the wire around the fixed hoop. In U.S. Pat. No. 4,422,250, Golan discloses a fabric holder having a fixed outer ring with an inner annular groove and an inner spring ring adapted to fit within the groove. Neither Golan nor Pettit provide means for easily adjusting the tension applied to a fabric secured on a ring.

A similar device employing an elastic cord, or fastener, that wraps around and attaches the fabric to a grooved hoop is disclosed by Dell in U.S. Pat. No. 5,303,486. Dell shows a tensioning device in which both ends of an elastic cord, or fastener, project through the back face of a clasp through a central aperture, and are each snapped into a pair of receiving groves on the front face of the clasp to hold the fastener in the desired tension. In this device both ends of the fastener are manipulated simultaneously to tighten the fastener from both ends, while simultaneously ensuring the clasp and workpiece remain properly positioned. Since two hands are typically used to manipulate the ends of the fastener, the tensioning and locking means is free to move about and may be inadvertently dislodged from the hoop. The difficulty in securing the clasp is exacerbated by the fact that the fastener ends pass behind the clasp and through a central opening on the back of the clasp, causing the clasp to sit off of the hoop with no inherent means for keying its position to the groove in the hoop. The result is a relatively difficult manipulation to fasten the elastic fastener in position at the correct tension. Also, because the clasp does not directly engage the hoop, it is susceptible to being inadvertently dislodged from the hoop by accidental twisting or bumping of the clasp.

Accordingly, it is desirable to provide a device which will support fabric materials having different thicknesses and which device is capable of being easily adjusted by one person to increase or decrease the force applied to the portion of the quilting material being mounted on the device, and to firmly and reliably position the elastic fastener in the desired location.

SUMMARY OF THE INVENTION

The present invention generally comprises an improved fabric workpiece holder for securing fabric material on which a craft is to be performed. The workpiece holder comprises a rigid hoop having an outer surface with a longitudinal groove. A fabric workpiece is draped over the hoop, and an elastic cord, longer than the perimeter of the hoop and having a cross-section sized to engage the groove, is wrapped around the hoop at the groove, with the fabric in between the cord and the hoop. A novel clasp is provided for securing the elastic cord in tension. The new clasp has an indexing protrusion on its back side that engages the longitudinal groove, and side-entry holes to receive the ends of the cord. A locking groove is provided on the front side of the clasp to secure the ends of the elastic cord while maintaining tension therein, thereby holding the fabric to the hoop.

Accordingly, it is an object of the present invention to provide an improved fabric workpiece holder having a single rigid hoop with a circumferential groove on its outer surface, an elastic cord sized to wrap around a fabric workpiece draped over the hoop and engage the circumferential groove, and a clasp for holding the elastic cord and maintaining tension thereon.

It is a further object of the present invention to provide such workpiece holder wherein the fabric workpiece may be easily installed on the holder and tension applied using one hand.

It is a further object of the present invention to provide such workpiece holder with a clasp that positively engages the groove on the hoop through the fabric workpiece thereby reducing the tendency for the clasp to cause the elastic cord to disengage from the hoop.

It is a further object of the present invention to provide such workpiece holder that can accommodate workpieces of different thickness.

It is a further object of the present invention to provide such workpiece holder that will allow the user to vary the amount of tension applied to the elastic cord holding the fabric workpiece.

DESCRIPTION OF THE DRAWINGS

FIG. 5 is a perspective view of a second preferred embodiment of the clasp wherein a longitudinal curvature is provided on the indexing ridge to approximately match curvature on the hoop.

FIG. 5A is a perspective view of the indexing means including at least two raised ribs.

FIG. 6 is a perspective view of the plug at the end of the elastic cord.

DESCRIPTION OF THE PREFERRED EMBODIMENT

Figure 1:
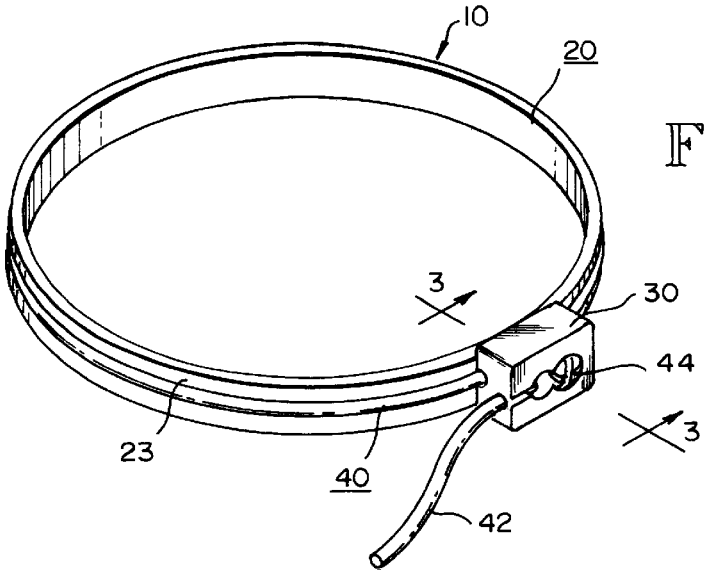
FIG. 1 is a perspective view of the quilting hoop of the present invention with the elastic cord installed but the fabric workpiece not shown.

Turning now to the drawings, the invention will be described in a preferred embodiment by reference to the numerals of the drawing figures. The preferred embodiment of the present invention for a fabric workholder comprises three main components, as can best be seen in FIG. 1: a rigid hoop 20 over which the fabric workpiece (not shown) is draped, an elastic cord 40 for securing the workpiece to the hoop 20, and a clasp 30 for releasably securing the ends of the cord 40 in tension. A fabric workpiece, such as quilting material, is placed over the hoop 20, with the desired work area more or less centered on the hoop 20 and pulled taut. As discussed below, the portion of the fabric workpiece over the hoop 20 is held firmly, to allow the desired sewing or other operation to be performed thereon.

The rigid hoop, preferably made from laminated wood, is sized to produce a flat fabric work area of a desired dimension. A circumferential groove 25, preferably rectangular or trapezoidal in cross section, is provided on the outer surface 23 of the hoop 20. The groove 25 in the preferred embodiment is located approximately midway between the top and bottom of the hoop 20. The thickness of the hoop 20 and the depth of the groove 25 may be selected such that the groove 25 is deep enough to accommodate and restrain the elastic cord 40, but does not compromise the structural integrity of the hoop 20. The precise dimensions will depend on the size and shape of the hoop 25, the tension desired in the elastic cord 40, and the material used to fabricate the hoop 25. Appropriate dimensions may be readily determined by one of ordinary skill in the art. In the preferred embodiment shown in FIGS. 1 the hoop 25 is circular. It is contemplated that other hoop shapes are possible, and may be desirable for specific applications. For example, oval or polygonal hoops having generally convex sides may be particularly suited to specific applications, such as particular-shaped quilts or where automated stitching machinery is to be used.

The length of the elastic cord 40 is preferably approximately equal to or greater than, the perimeter of the hoop 20 and may be fabricated from any stretchable cord that is sufficiently pliable to securely wrap around the hoop 20 and be insertable into the clasp 30 and locking groove 39, while maintaining a tension within the elastic cord 40. For example, a cord having a central elastic material with a cloth outer covering, such as that marketed under the trademark Bungie Cord makes a satisfactory elastic cord 40. Elastic cords having non-circular cross-sections (not shown) may be used to improve the holding force applied to the fabric workpiece. For example, rubber or synthetic cords having rectangular or other non-circular cross section sized to match a similar groove 25 in the hoop would increase the surface area in contact with the fabric, improving the ability of the apparatus to hold the fabric without slippage. Also, nibs or longitudinal grooves may be provided to increasing the gripping properties of the elastic cord 40.

Figure 2:
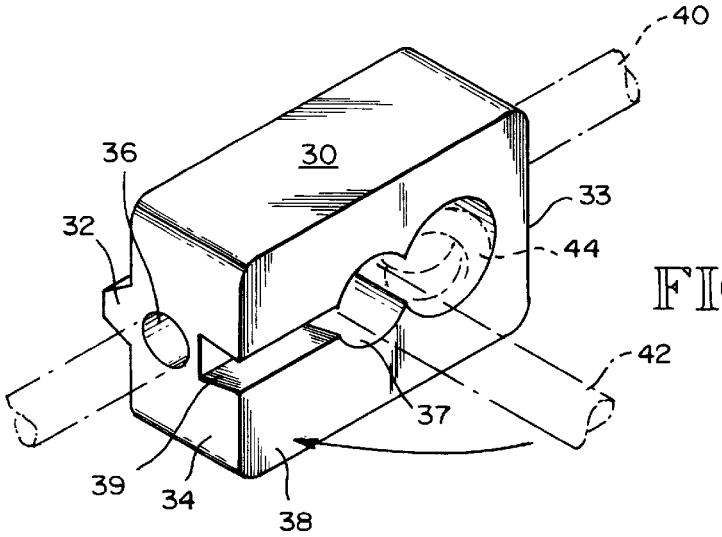
FIG. 2 is a perspective view of the clasp of the preferred embodiment shown in FIG. 1.
Figure 3:
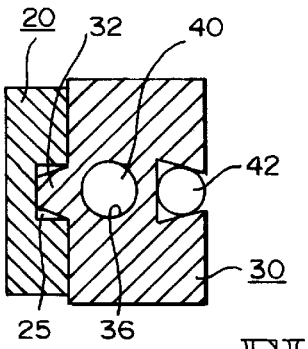
FIG. 3 is a view along line 3—3 of FIG. 1.
Figure 4:
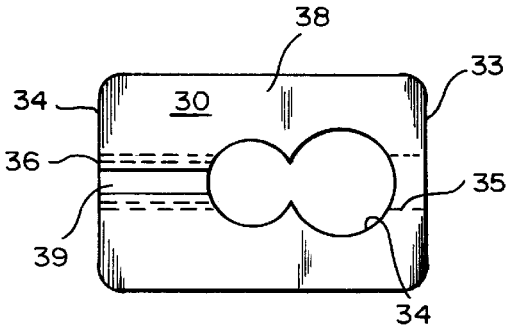
FIG. 4 is a plan view of the clasp of the preferred embodiment shown in FIG. 1.

The clasp 30 in the preferred embodiment is shown in FIGS. 2 through 4. The elastic cord ends 42, 44 are inserted through transverse holes 35, 36 of the clasp 30. In the preferred embodiment, one end of the elastic cord 44 has a knot tied into it after it is threaded through hole 35, thereby preventing that end 44 from being pulled out of the clasp 30. It will be obvious to one of ordinary skill in the art that there are many other methods of constraining one end of the elastic cord 44 from being pulled out of the clasp 30. For example, the elastic cord may be fabricated with one large end, and threaded through the clasp from the other end, or staples, tape or a plug may be affixed to one end of the elastic cord 44. For certain materials that might be selected for the elastic cord 40, heating one end 44 may be used to cause melting or expansion to enlarge the diameter.

An innovative feature of the clasp is an indexing means, preferable an integral ridge 32 formed on the back of the clasp 30 that engages the groove 25 in the hoop 20, thereby slidably indexing and locking the clasp into place on the hoop 20. The unique placement of the holes 35, 36 for receiving the elastic cord 40 on the sides of the clasp 30 allows the clasp ridge 32, or other indexing means, to engage the groove 25 without interference, and because the elastic cord 40 is thereby pulled slightly away from the hoop 20, a restorative force pulls the clasp 30 toward the hoop 20, thereby further securing the clasp 30 to the hoop 20. The ridge 32 engaging the groove 25 also prevents any tendency of the clasp 30 to rotate in the plane of the hoop outer surface 23, which might otherwise cause the elastic strap 40 to inadvertently disengage from the groove 25. As shown in FIG. 5, a second preferred embodiment of the clasp 130 incorporates a longitudinal concave curvature in the ridge 132 provided to approximately match the curvature of the hoop 20. Other indexing means contemplated by this invention include two or more spaced nibs or other raised portions, that are sized to engage the groove 25.

A portion of the clasp is cut out 37 from the front face 38, partially through the clasp 30. The cut out portion 37 is intended to accommodate the enlarged or knotted end 44 of the elastic strap 40 so that the cord end 44 does not protrude from the clasp face 38, providing a more aesthetically appealing configuration.

A locking groove 39 is cut into the face 38 of the clasp 30. The locking groove 39 of the preferred embodiment is a dovetail-shaped groove with the narrower portion of the groove open to the face 38 of the clasp 30 and parallel to the hole 36. Other groove shapes are, of course, possible, including a circular groove with a portion open to the clasp face 38. The size of the locking groove 39 is selected to provide a tight, friction fit with the elastic cord 40, after the end of the elastic cord 42 has been threaded through the hole 36, and bent or folded 180 degrees to engage the locking groove 39. The tight fit in the locking groove combined with the 180 degree bend provides a very secure grip on the elastic cord 40, allowing the device to maintain the elastic cord 40 with significant tension.

Although the clasp 30 shown in the preferred embodiment is generally rectangular, other shapes are also contemplated, and would be equivalent to the present invention. For example, the clasp may be generally circular, diamond-shaped, hemispherical, or any number of novelty shapes. In the preferred embodiment, the clasp is made from a single piece of wood, although suitable plastic or metal clasps would be within the contemplated scope of the present invention.

In operation, the desired fabric is draped over the hoop 20 of the fabric workpiece holder 10. The enlarged end 44 of the elastic cord 40 is pre-installed in the clasp 30, and the other end 42 of the elastic cord 40 has been threaded through the hole 36, to form a loop of elastic cord 40 approximately as large as the outside diameter of the hoop 20. The loop of elastic cord 40 is placed around the fabric directly over the groove 25, and the ridge 32 on the clasp 30 is slid into the groove 25, with the fabric between the ridge 32 and the groove 25. With the fabric adjusted to produce a flat portion directly above the hoop, the end 42 of the elastic cord 40 is pulled to move the elastic cord 40 into the groove 25 and provide a tensile force in the elastic cord 40. The end 42 is than bent 180 degrees and snapped into the locking groove 39.

Since certain changes may be made in the above-described system and apparatus without departing from the scope of the invention herein involved, it is intended that all matter contained in the description or shown in the accompanying drawings shall be interpreted as illustrative and not in a limiting sense.

We claim:

1. A fabric workpiece holder comprising:

i) a hoop having an outer surface, said outer surface having a groove circumscribing said hoop;

ii) an elastic cord having a first and second end, a length L and a transverse dimension D wherein said length L is not substantially less than the perimeter of said hoop and said transverse dimension D is not significantly greater than the width of said groove, whereby said elastic cord may be wrapped around the perimeter of said hoop in engagement with said groove;

iii) a clasp for securing said elastic cord in tension after said elastic cord has been wrapped around said hoop, said clasp comprising a back face, oppositely disposed first and second clasp ends, and a front face, wherein said back face has an indexing means thereon for engaging said groove; said first clasp end has a first longitudinal aperture large enough to insertably receive said cord and said second clasp end has a second longitudinal aperture large enough to insertably receive said cord; and said front face has a cutout portion partially cut through said clasp and intersecting said first and second longitudinal apertures whereby said cord may be inserted through said first and second clasp apertures to form a loop large enough to wrap around said hoop; said front face further including at least one locking groove sized to slidably receive a portion of said cord in a friction fit;

whereby a fabric workpiece may be draped over said hoop and secured thereto by wrapping said cord around said fabric over said groove and securing said cord in a stretched state with said clasp.

2. The fabric workpiece holder of claim 1 wherein said elastic cord has a circular cross-section.

3. The fabric workpiece holder of claim 1 wherein said second cord end further comprises an enlarged portion having a transverse dimension large enough to prevent said second cord end from being pulled through said second longitudinal aperture.

4. The fabric workpiece holder of claim 1 wherein said at least one locking groove is generally trapezoidal in cross-section.

5. The fabric workpiece holder of claim 3 wherein said enlarged portion is formed by tying an overhand knot in said cord.

6. The fabric workpiece holder of claim 3 wherein said enlarged portion is formed by attaching a plug to said second cord end.

7. The fabric workpiece holder of claim 1 wherein said indexing means comprises a ridge extending between said first and second ends of said clasp.

8. The fabric workpiece holder of claim 6 wherein said ridge is provided with a transverse radius of curvature to substantially match a radius of curvature of said hoop groove.

9. The apparatus of claim 7 wherein said ridge is substantially trapezoidal in cross section.

10. The fabric workpiece holder of claim 1 wherein said indexing means comprises at least two raised nibs.

11. A method of holding a fabric workpiece in tension comprising the steps of:

i) draping said fabric workpiece over a hoop having a circumferential groove on its outer surface such that the portion of said fabric workpiece over said hoop is generally flat;

ii) wrapping an elastic cord around said hoop over said groove with a portion of said fabric workpiece between said groove and said elastic cord, said elastic cord having a first and second end, said first end having a clasp with an indexing ridged portion affixed thereto;

iii) indexing said clasp to said hoop by placing said ridged portion over said groove to engage said groove;

iv) tensioning said elastic cord whereby said elastic cord engages said groove;

v) maintaining said tension in said elastic cord by affixing said second end of said elastic cord to said clasp.

* * * * *